US005287680A

United States Patent [19]

Lau

[11] Patent Number: 5,287,680

[45] Date of Patent: Feb. 22, 1994

[54] VACUUM PACKING DEVICE

[75] Inventor: Yen Lau, Fo Tan, Hong Kong

[73] Assignee: Specialite Industries Ltd., Hong Kong

[21] Appl. No.: 926,233

[22] Filed: Aug. 6, 1992

[51] Int. Cl.[5] ..... B65B 31/06; B65B 67/02; B65B 61/18

[52] U.S. Cl. ..... 53/512; 53/373.2; 53/390; 53/133.4; 53/139.2

[58] Field of Search ..... 53/133.4, 139.2, 373.2, 53/390, 434, 512

[56] References Cited

U.S. PATENT DOCUMENTS

| | | | |
|---|---|---|---|
| 3,939,287 | 2/1976 | Orwig et al. | 53/512 X |
| 4,744,196 | 5/1988 | Gallo | 53/390 X |
| 4,860,523 | 8/1989 | Teteishi et al. | 53/512 |
| 5,048,269 | 9/1991 | Deni | 53/512 |
| 5,140,796 | 8/1992 | Pope | 53/390 |

*Primary Examiner*—John Sipos
*Assistant Examiner*—Linda B. Johnson
*Attorney, Agent, or Firm*—Samuels, Gauthier & Stevens

[57] ABSTRACT

A hand held vacuum packing device, for use in the home in evacuating and sealing a plastic bag containing food, consists of jaws through which the edges of the bag are pulled to press fit the edges together and a nozzle and air extractor to withdraw air from the bag immediately before sealing is complete.

2 Claims, 3 Drawing Sheets

VACUUM PACKING DEVICE

FIELD AND BACKGROUND OF THE INVENTION

The present invention relates to vacuum packing apparatus.

Vacuum packing apparatus is used by food processors to vacuum pack food for sale to the public so as to keep the food fresh.

The vacuum packing apparatus used by food processors is intended for use in factories and is not suitable for use in the home, being too large, combersome and expensive for home use.

OBJECT AND SUMMARY OF THE INVENTION

An object of the present invention is to provide vacuum packing apparatus suitable for home use. Such apparatus may be useful in a situation in which the consumer uses a part only of some packaged food and wishes to repack the remainder for use at a later date. Such apparatus may also be useful for packing fresh fruit or vegetables which have been bought unpackaged. Such apparatus may also be used in packaging cooked meals for freezing and for use at a later date. Such apparatus must be inexpensive, safe, simple to operate and compact in size. A particular object of the invention is to provide a small hand held device which may be used in conjunction with commercially available plastic bags of the type comprising two edges which may be press-fitted together to seal the bag, the device being useful to extract air from the bag before sealing is complete.

The invention provides a vacuum packing device for use in evacuating and sealing a plastic bag comprising:

- a housing which serves as a handle by means of which the device may be held in one hand;
- a nozzle projecting from the housing for insertion between the two free edges of the plastic bag to be sealed;
- a suction device located in the housing and associated with the nozzle for extracting air from the plastic bag; and
- a jaw projecting from the housing and provided with a slot for receiving the two edges of the plastic bag, the jaw and nozzle being moveable relative to one another between an open position for initially receiving the two edges of the bag and a closed operational position for sealing the bag.

In use, food is placed in a plastic bag of the type described. The plastic bag is then held in one hand and the vacuum packing device in the other hand, and with the nozzle and jaw in the open position, the two edges are placed in the slot and the nozzle is inserted between the two edges. The nozzle and jaw are then closed and the two edges of the bag are pulled past the nozzle through the slot thus sealing the two edges together. When the edges have been sealed along almost their entire length, so that the nozzle projects into the remaining small unsealed length of the edges, the extractor is operated to withdraw air from the plastic bag. The nozzle and jaw are then opened, the vacuum packing device removed from the plastic bag, and the remaining length of the edges is sealed by hand.

Preferably the device includes a battery chamber for receiving a battery to power the suction device.

Other objects and advantages will become apparent from the description which follows.

DETAILED DESCRIPTION OF THE PREFERRED EMBODIMENT

Figure 1:
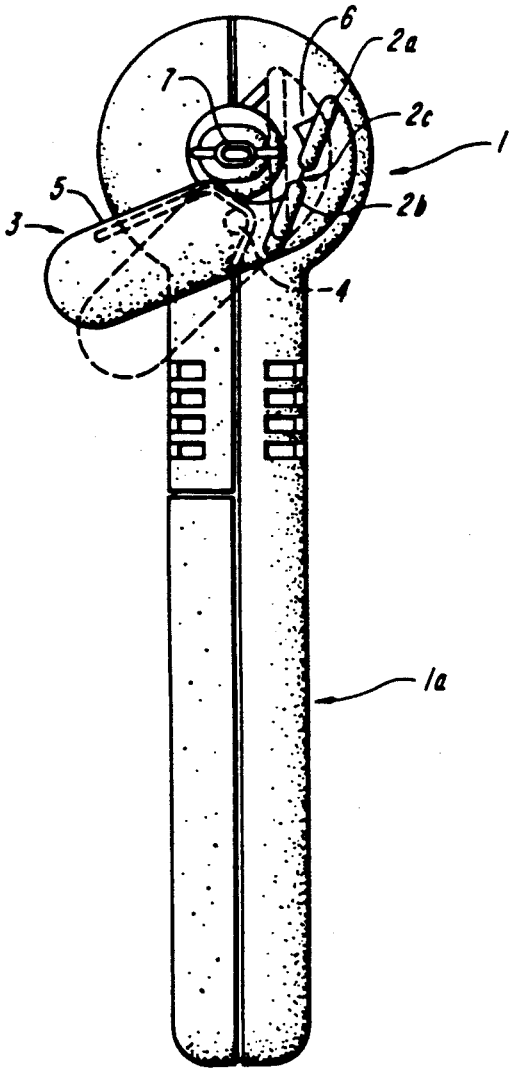
FIG. 1 is a front view of the vacuum packing device.
Figure 2:
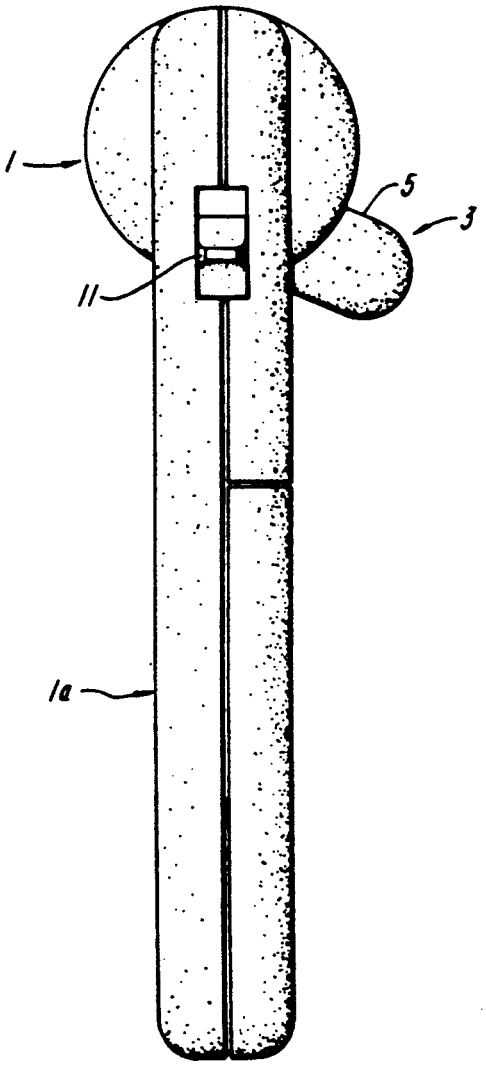
FIG. 2 is a rear view.
Figure 3:
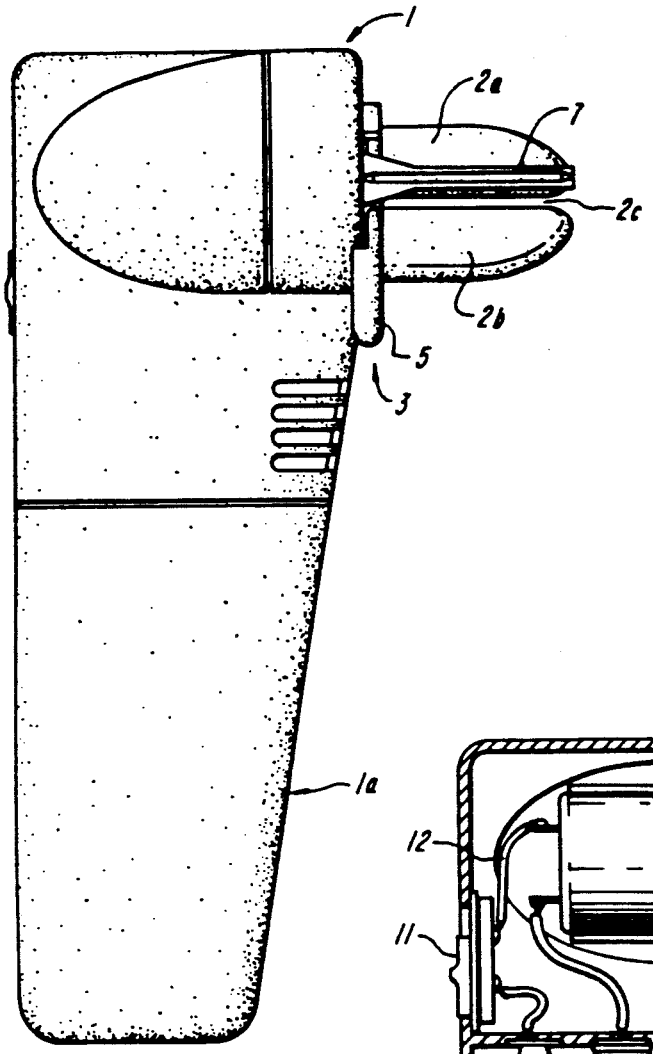
FIG. 3 is a side view.
Figure 4:
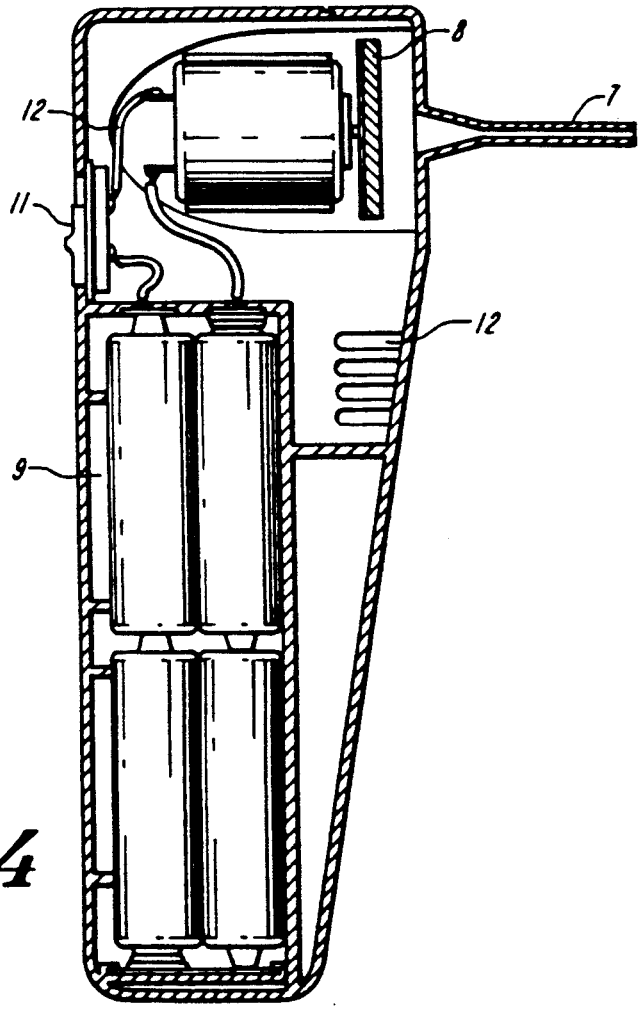
FIG. 4 is a sectional side view.

Referring to the drawings, and especially to FIGS. 1 to 4, the vacuum packing device comprises a housing 1 the lower part 1*a* of which serves as a handle; a moveable jaw comprising two jaw elements 2*a*, 2*b* defining a slot 2*c*; a lever 3 on which the jaw elements 2*a*, 2*b* are mounted; a pivotal mounting 4 by means of which the lever 3 is mounted on the housing 1; a spring 5 for biassing the lever 3 and moveable jaw 2*a*, 2*b* to the open position as shown in FIG. 1; a stop 6 on the housing for limiting the movement of the lever 3 and jaw 2*a*, 2*b* against the spring biassing; a nozzle 7; an extractor fan 8 in the housing 1; a battery chamber 9 in the housing 1; a battery 10 in the battery chamber 9; a switch 11 mounted externally on the rear of the housing 1; electrical circuitry 12 connecting the extractor fan 8, the battery 10 and the switch 11; and vents 12 through which air from the extractor fan 8 is exhausted to the atmosphere.

Figure 5:
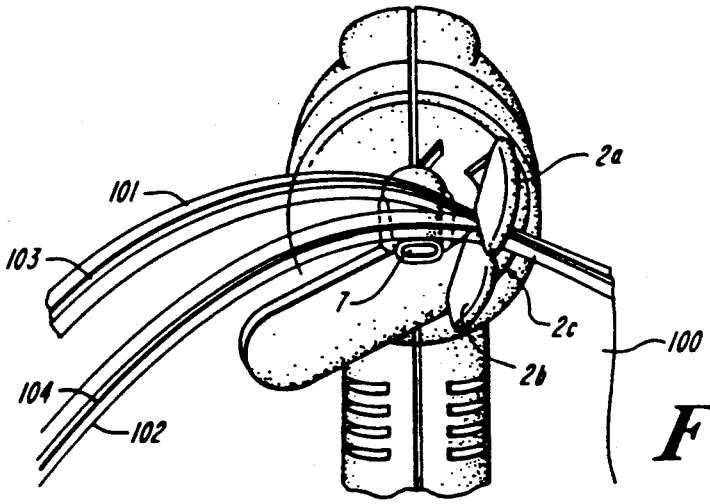
FIG. 5 is a front view illustrating the use of the device, and showing the two edges of a plastic bag, but with the remainder of the bag omitted for clarity.

The use of the device will now be described with particular reference to FIGS. 5, 6 and 7. Food (not shown) is placed in a plastic bag 100 which has two free edges 101, 102 provided with beading 103, 104 which allows the two edges to be pressed fitted together to seal the bag. The bag is of well known type and forms no part of the invention.

The first step in use of the vacuum packing device is that with the jaw 2*a*, 2*b* in the open position as illustrated in FIG. 1, the two edges 101, 102 of the plastic bag are both threaded together into the slot 2*c* between the two jaw elements 2*a*, 2*b* and are disposed on opposite sides of the nozzle 7 which therefore projects into the bag 100. The lever 3 is then operated to bring the moveable jaw 2*a*, 2*b* to the closed position, as best seen in FIG. 5. The bag 100 which is held in one hand and the vacuum packing device which is held in the other hand are then pulled in opposite directions, so that the two edges 100, 102 of the bag are pulled past the nozzle 7 and through the slot 2*c*, as best seen in FIG. 5. In this manner the two edges 101, 102 of the bag 100 are brought into sealing engagement with one another.

When almost the entire length of the two edges 101, 102 of the bag 100 has been pulled through the slot 2*c*, so that the bag 100 is sealed along almost the entire length of the edges 101, 102, the extractor fan 8 is then operated by pressing the switch 11. As a result air is extracted from the bag 100 through the nozzle 7, the extractor fan 8, and is exhausted to atmosphere through the vents 12. When substantially all of the air has been removed from the bag 100, finger pressure on the lever 3 is released to open the jaw 2*a*, 2*b* and nozzle 7, and the vacuum packing device is withdrawn from the bag 100, and the sealing of the bag 100 is completed manually.

Figure 6:
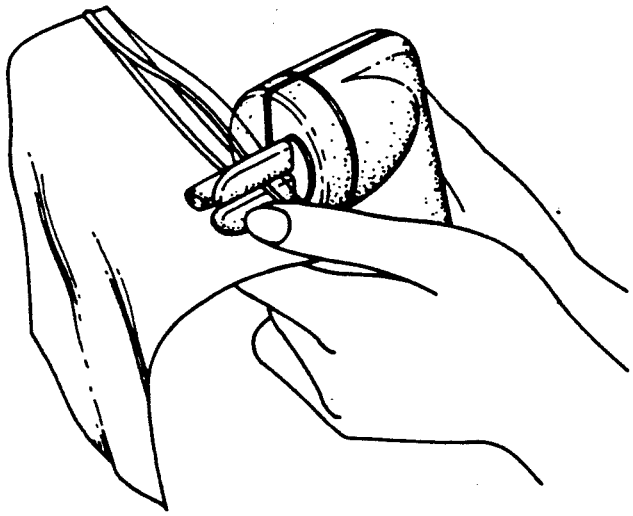
FIG. 6 is a perspective view of the use of the device at the beginning of sealing the bag.

FIG. 6 is a perspective view at the beginning of sealing the bag 100, and showing the vacuum packing device held in the right hand, the bag 100 held in the left hand, and showing the bag just as pulling the edges 101, 102 through the slot 2*c* has commenced.

Figure 7:
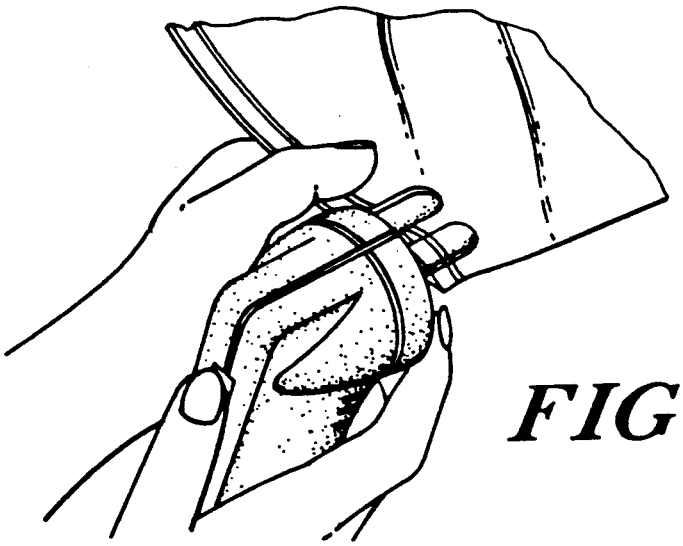
FIG. 7 is an alternative perspective view at the end of sealing the bag.

FIG. 7 shows the bag 100 almost completely sealed, and shows the thumb of the right hand operating the switch 11 to extract air from the bag 100.

It will be appreciated from the foregoing description and from the drawings that the device is simple and inexpensive in construction, and safe and easy to use, and compact to store.

I claim:

1. A vacuum packing device for use in evacuating and sealing a plastic bag having two free edges comprising:

a portable housing which serves as a handle by means of which the device may be held in one hand and moved along the two free edges;

a nozzle projecting from the housing for insertion between the two free edges of the plastic bag to be sealed;

a suction device located in the housing and associated with the nozzle for extracting air from the plastic bag; and a jaw member projecting from the housing and provided with a slot for receiving the two free edges of the plastic bag, means for pivotably mounting said jaw member and slot on said housing whereby the jaw member with the slot and the nozzle are moveable relative to one another between an open position for initially receiving the two free edges of the bag and a closed operational position in which said jaw member and said nozzle are disposed immediately adjacent each other for sealing the bag as said jaw member and nozzle are moved along the two free edges.

2. A device according to claim 1 which includes a battery chamber for receiving a battery to power the suction device.

* * * * *